US005808228A

United States Patent [19]

Beschle et al.

[11] Patent Number: 5,808,228

[45] Date of Patent: Sep. 15, 1998

[54] PROTECTION DEVICE FOR A DOOR GAP IN AN ARMORED SPECIAL VEHICLE

[75] Inventors: Klaus Beschle; Christian Jauss; Peter Krueck, all of Boeblingen; Josef Schumacher, Reutlingen; Juergen Uhlenberg, Grafenau, all of Germany

[73] Assignee: Daimler-Benz Aktiengesellschaft, Stuttgart, Germany

[21] Appl. No.: 889,940

[22] Filed: Jul. 10, 1997

[30] Foreign Application Priority Data

Jul. 11, 1996 [DE] Germany ..... 196 28 065.6

[51] Int. Cl.[6] ..... F41N 7/02

[52] U.S. Cl. ..... 89/36.02; 89/36.08; 89/36.14; 109/74

[58] Field of Search ..... 89/36.14, 36.08, 89/36.07, 36.13, 36.02, 36.04; 109/77, 49.5, 74, 75, 76

[56] References Cited

U.S. PATENT DOCUMENTS

| | | | |
|---|---|---|---|
| 4,132,446 | 1/1979 | Bauer | 296/155 |
| 4,598,647 | 7/1986 | Biedess | 109/77 |
| 4,741,277 | 5/1988 | Salzer | 109/77 |
| 4,864,819 | 9/1989 | Steyer | 60/264 |
| 4,962,710 | 10/1990 | Habicht et al. | 109/79 |

FOREIGN PATENT DOCUMENTS

| | | | |
|---|---|---|---|
| 0 456 993 | 11/1991 | European Pat. Off. . | |
| 36 39 781 C1 | 6/1988 | Germany . | |
| 3735133 | 5/1989 | Germany | 89/36.14 |
| 43 35 336 A1 | 4/1995 | Germany . | |
| 2 106 636 | 4/1983 | United Kingdom . | |
| 9429665 | 12/1994 | WIPO | 89/36.07 |

*Primary Examiner*—Stephen M. Johnson
*Attorney, Agent, or Firm*—Evenson, McKeown, Edwards & Lenahan, P.L.L.C.

[57] ABSTRACT

A protective device for a door gap between a door and a door frame in the body of an armored, specially protected vehicle. The device prevents projectile splinters from penetrating the interior of the vehicle, and is intended to reduce the door aperture as little as possible when the door is opened. For this purpose, partitions extend from the frame of the door into the door gap. As a result, the gap-covering armor that extends into the door opening area beyond the door frame when the door is opened has a relatively limited extent in the free door aperture area. One of the projectile-deflecting projections on the frame of the door is an anti-splinter strip mounted on the inside of the door and projecting into the door gap, said strip preventing the parts of a broken-up projectile from penetrating the interior of the vehicle and/or deflecting those parts that do penetrate into areas that are noncritical for the vehicle occupants.

4 Claims, 1 Drawing Sheet

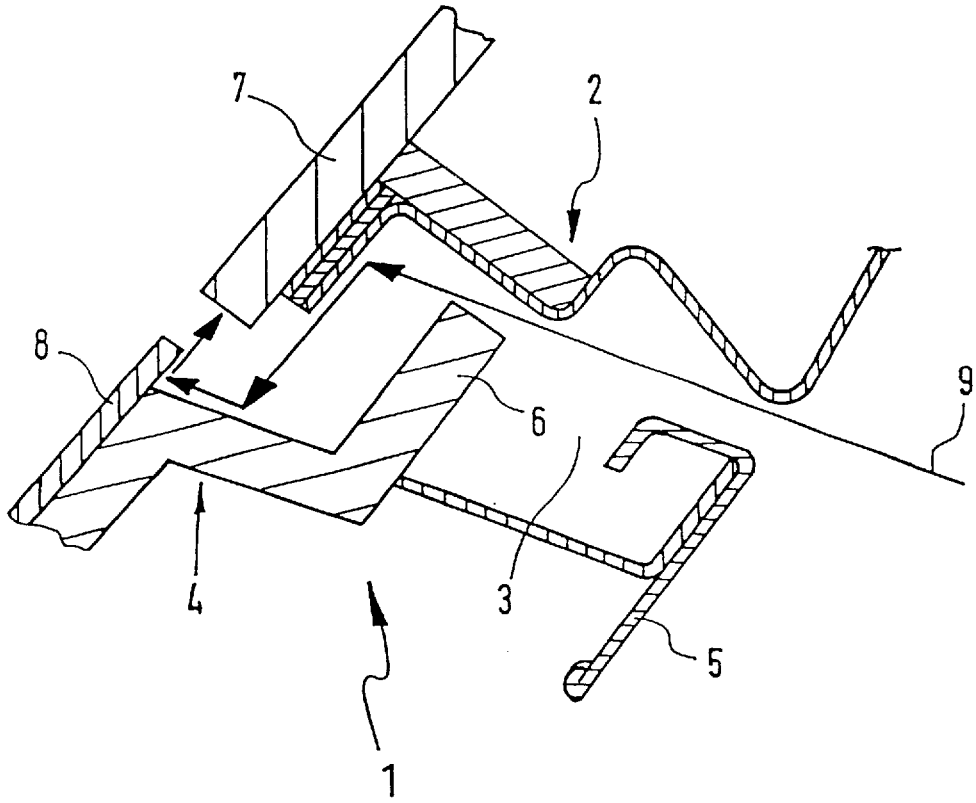
7
2
8
6
9
4
3
5
1

PROTECTION DEVICE FOR A DOOR GAP IN AN ARMORED SPECIAL VEHICLE

BACKGROUND AND SUMMARY OF THE INVENTION

This application claims the priority of German Application No. 196 28 065.6 filed in Germany on Jul. 11, 1996, the disclosure of which is expressly incorporated by reference herein.

The invention relates to a protective device for a door gap in an armored, specially protected vehicle.

A device of this kind is known from German Patent Document DE 36 39 781 C1.

The end of the door gap facing the vehicle interior in that document is completely covered by an armor plate that extends from the door frame parallel to the door opening. This armor plate therefore also covers a marginal area of the door, relative to which it has a small gap in the direction normal to the door opening plane. Because the door gap is covered, starting at the door frame, by an armor plate that extends to the marginal area of the door, the door aperture that results when the door is opened is considerably restricted. At the same time, the areas of the armor plate that extend beyond the door gap increase the weight.

A goal of the invention is to provide an improved protective device for a door gap in an armored, specially protected vehicle.

This and other goals have been achieved according to the present invention by providing a protective device for a body of an armored vehicle, comprising: a vehicle door frame defining a door opening; a vehicle door arranged in said opening and spaced at a distance from said vehicle door frame to define a door gap therebetween, said door gap having a depth defined between an interior vehicle side and an exterior vehicle side, said door comprising a protective profile which forms an edge on said interior side and which extends into the door gap; a protective strip projecting from the protective profile approximately in the center of said depth of the door gap, the protective strip projecting only partially into the door gap in a direction approximately parallel to a plane of the door opening, the protective strip having a thickness less than said depth of the door gap; an armor plate extending approximately parallel to said plane of the door opening from an edge of the door frame on said interior vehicle side and at least partially covering said door gap; and an anti-splinter protective strip mounted on said protective profile on said interior vehicle side, said strip extending approximately parallel to the armor plate and at least partially covering said door gap.

The invention is based on the idea of making a part of the widthwise door gap covering on the frame of the door as large as possible in order to obtain the largest possible door aperture when the door is opened, or to reduce as little as possible, if at all, a door aperture in a non-armored vehicle by means of a door gap protective device.

Other objects, advantages and novel features of the present invention will become apparent from the following detailed description of the invention when considered in conjunction with the accompanying drawings.

BRIEF DESCRIPTION OF THE DRAWINGS

The drawing shows a horizontal section through a door mounted in a frame, in the gap area between these two parts, according to a preferred embodiment of the present invention.

DETAILED DESCRIPTION OF THE DRAWINGS

A door 1 is mounted in a door frame 2 in the body, with a gap 3 between them.

Door frame 2 is located in the area of the side wall of an armored specially protected vehicle and is embedded in the body of the vehicle.

A protective profile 4 made of armor steel for example and fitting over the inner edge of the door frame forms a part of the frame of door 1 on the side facing the vehicle interior. An external profile part 5 abuts protective profile 4 on the exterior of the vehicle, said profile part blending on the outer surface of the vehicle approximately flush with the body surface at door frame 2. A pane of bulletproof glass, not shown, is mounted in the door between protective profile 4 and external profile part 5.

Protective profile 4 is made approximately Z-shaped in cross section. One of the two short legs together with the middle part of the Z forms the inner edge area of door 1. The second short leg is located inside door gap 3 and there covers a door gap area that faces the vehicle interior by means of an outwardly directed area in the shape of a protective strip 6. Protective strip 6 runs approximately perpendicularly to the depth of the door gap and maintains a distance from door frame 2. The protective profile, which is in one piece and includes the protective strip in the example shown, can also be assembled from individual pieces.

On the vehicle interior side, an armor plate 7 that runs parallel to the door opening plane extends over door frame 2 into gap 3. This armor plate 7 does not cover the entire width of gap 3 between door frame 2 and the protective profile 4 of door 1. Since the distances between armor plate 7 and protective profile 4 of door 1 on the one hand and protective strip 6 and door frame 2 on the other hand are on opposite ends of the width of the door gap, a direct penetration of a projectile is ruled out. In the space located at the boundary of the vehicle interior, between protective profile 4 of door 1 and armor plate 7 on the door frame side, an anti-splinter strip 8 projects from protective profile 4, said strip being aligned in approximately the same plane as armor plate 7.

The protective profile 4 with protective strip 6, armor plate 7, and anti-splinter strip 8, form a type of labyrinth seal in the area of gap 3 that abuts the interior of the vehicle to stop parts of a projectile 9 penetrating from the outside, that penetrates the outer area of gap 3 and breaks up there at protective strip 6.

As a result, protective strip 6 in gap 3, cooperating with the armored area of door frame 2, ensures that a projectile penetrating the gap from the outside can pass through armored strip 6 to the interior of the vehicle only after breaking up. Fragments of projectile 9, which as a result can still penetrate the interior of the vehicle, are reliably retained by anti-splinter strip 8 projecting into gap 3 or are at least deflected in a direction that is noncritical for the vehicle occupants.

The great advantage of the protective device according to the invention consists in the fact that it reduces the size of the door aperture, practically speaking, only slightly if at all and thereby increases the weight to only an insignificant degree.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A protective device for a body of an armored vehicle, comprising:

a vehicle door frame defining a door opening;

a vehicle door arranged in said opening and spaced at a distance from said vehicle door frame to define a door gap therebetween, said door gap having a depth defined between an interior vehicle side and an exterior vehicle sides;

a protective profile having an essentially Z-shaped cross-section including first, second, and third legs, said first leg defining an edge of the door on said interior side, said second leg extending from said first leg and defining an edge of the door which faces the door gap, and said third leg extending from said second leg into the door gap in a direction approximately parallel to a plane of the door opening, the third leg having a thickness less than said depth of the door gap;

an armor plate extending approximately parallel to said plane of the door opening from an edge of the door frame on said interior vehicle side and at least partially covering said door gap; and an anti-splinter protective strip mounted on said first leg of the protective profile on said interior vehicle side, said strip extending approximately parallel to the armor plate and at least partially covering said door gap, a space between said third leg of the protective profile and said door frame being laterally offset from a space between said armor plate and said anti-splinter protective strip, such that said second and third legs of the protective profile, said armor plate, and said anti-splinter protective strip form a labyrinth seal in the door gap.

2. A protective device according to claim 1, wherein said door opening defines an opening into a passenger compartment of said vehicle.

3. A protective device according to claim 1, wherein said protective profile consists of a single integral piece.

4. A protective device according to claim 1, wherein said third leg extends from said second leg approximately in the center of said depth of the door gap.

* * * * *